United States Patent [19]

Argazzi

[11] Patent Number: 4,583,965

[45] Date of Patent: Apr. 22, 1986

[54] ASSEMBLY FOR UNFOLDING FLATTENED CARTONS IN PACKAGING MACHINERY

[75] Inventor: Ivo Argazzi, Pianoro Nuova, Italy

[73] Assignee: Industria Macchine Automatiche - S.p.A., Zola Predosa, Italy

[21] Appl. No.: 692,857

[22] Filed: Jan. 17, 1985

Related U.S. Application Data

[63] Continuation of Ser. No. 387,014, Jun. 10, 1982, abandoned.

[30] Foreign Application Priority Data

Jun. 11, 1981 [IT] Italy ..... 3457 A/81

[51] Int. Cl.[4] ..... B31B 1/80

[52] U.S. Cl. ..... 493/313

[58] Field of Search ..... 53/564; 493/316; 198/740

[56] References Cited

U.S. PATENT DOCUMENTS

| | | | |
|---|---|---|---|
| 1,979,207 | 10/1934 | Milmoe | 53/566 X |
| 2,728,177 | 12/1955 | Holstebroe et al. | 53/566 X |
| 3,027,815 | 4/1962 | Anness et al. | 493/313 X |
| 3,078,769 | 2/1963 | Flynn et al. | 493/9 |
| 3,097,577 | 7/1963 | Salwasser et al. | 493/313 |
| 3,504,596 | 4/1970 | Hirasuna | 493/313 X |
| 3,513,618 | 5/1970 | Woodruff et al. | 53/566 X |
| 3,533,334 | 10/1970 | Schuster | 493/316 X |
| 4,035,989 | 7/1977 | Schuster | 53/566 |
| 4,057,008 | 11/1977 | Hughes | 493/314 |
| 4,066,009 | 1/1978 | Calvert et al. | 493/316 |
| 4,081,945 | 4/1978 | Calvert et al. | 53/201 X |
| 4,137,528 | 1/1979 | Traise | 493/12 X |

*Primary Examiner*—John Sipos
*Assistant Examiner*—Steven P. Weihrouch
*Attorney, Agent, or Firm*—Karl F. Ross; Herbert Dubno

[57] ABSTRACT

Flattened cartons or containers stacked in a hopper of a packaging machine are successively removed from the hopper by an extractor including a vertically reciprocable suction-cup carrier engageable with the bottom section of the lowermost carton in the stack which initially is coplanar with an adjoining lateral section. The latter section, during the descent, comes to rest against a stationary ramp; the incipient erection of that lateral section by its engagement with the ramp is accelerated by a pair of swingable arms flanking the ramp, these arms being pivoted into a vertical position for area contact with the side of the passing carton. Possible malfunctions can be detected by a pressure sensor communicating with the suction line or by a photosensor in line with an area occupied by an end section of the carton in the unfolded position thereof.

7 Claims, 5 Drawing Figures

ASSEMBLY FOR UNFOLDING FLATTENED CARTONS IN PACKAGING MACHINERY

This is a continuation of co-pending application Ser. No. 387,014 filed on June 10, 1982 now abandoned.

FIELD OF THE INVENTION

My present invention relates to a device for the unfolding of flattened cartons or containers as used in packaging machinery in which such cartons are stacked in a hopper and, after unfolding, are loaded with articles inserted endwise from, say, an adjacent conveyor.

BACKGROUND OF THE INVENTION

The cartons here considered are four-sided containers with bottom, top and lateral sections interlinked by parallel fold lines whereby, in their flattened state, one lateral section is copolanar with the bottom section and is overlain by the top section which in turn is coplanar with the other lateral section overlying the bottom section. During each operating cycle of the packaging machine, an extractor underneath the hopper engages the bottom section of the lowermost carton of the stack with the aid of vertically reciprocable suction means and, in a descending stroke, withdraws that carton from the hopper past an adjacent deflector which engages an adjacent lateral section for erecting same. This motion expands the flattened carton into its unfolded state facilitating an endwise introduction of the goods to be packaged.

In a prior assembly of this sort, the deflector has a stationary ramp lying in the path of descent of an edge of the carton constituted by the fold line linking the adjacent lateral section with the top section thereof. As that edge is being cammed inward by the sloping ramp surface, a position is soon reached in which that lateral section lies flat against the ramp whereupon the zone of contact shifts instantaneously from the upper to the lower part of the ramp, with resulting foreshortening of the moment arm and a change in the angle of attack subjecting the carton to undesirable vertical stress components. This, especially with high-speed operation, may have a damaging effect upon the workpieces.

OBJECTS OF THE INVENTION

The general object of my present invention, therefore, is to provide an improved assembly for unfolding flattened cartons or containers, extracted from a hopper in the aforedescribed manner, which obviates this drawback and allows a packaging machine so equipped to operate at a higher rate of production.

Another object of my invention is to provide means in such an assembly for detecting possible malfunctions in order to alert an operator or arrest the machine whenever workpieces—i.e. flattened cartons—are not regularly extracted from the hopper or are not unfolded properly.

SUMMARY OF THE INVENTION

In accordance with my present invention, an unfolding assembly of the general type referred to comprises deflector means including, besides the aforementioned stationary ramp, a swingable member adjacent that ramp which is pivotable about an axis paralleling the fold lines of a carton or container removed by an associated extractor from an overlying hopper or stacking tube, the swingable member being synchronized with the extractor for moving from a normal position retracted beyond the ramp to an upright position closely adjoining the path of descent of a fold line which links the bottom section of the extracted carton with its first or proximal lateral section. The swingable member, which preferably comprises two interconnected arms flanking the stationary ramp, disengages the first lateral section from the ramp face before this section has come into full contact with that face; its pivotal motion positively displaces the entire carton into its unfolded or expanded state without further camming action.

Generally, a carton of the type here considered also has two end sections constituting extensions of a single section or of two different sections of the group previously referred to, these end sections being separately foldable to close the carton or container after it has been loaded. When a carton pulled from the hopper by the extractor is unfolded, an end section extending from either the top section or the second lateral section of the container body will move away from the other two body sections so as to occupy a position remote therefrom. If, for any reason, the extracted carton fails to unfold, such malfunction can be detected by a photosensor aligned with the unfolded position of that end section in accordance with another feature of my present invention.

BRIEF DESCRIPTION OF THE DRAWING

The above and other features of my invention will now be described in detail with reference to the accompanying drawing in which.

SPECIFIC DESCRIPTION

Figure 1:
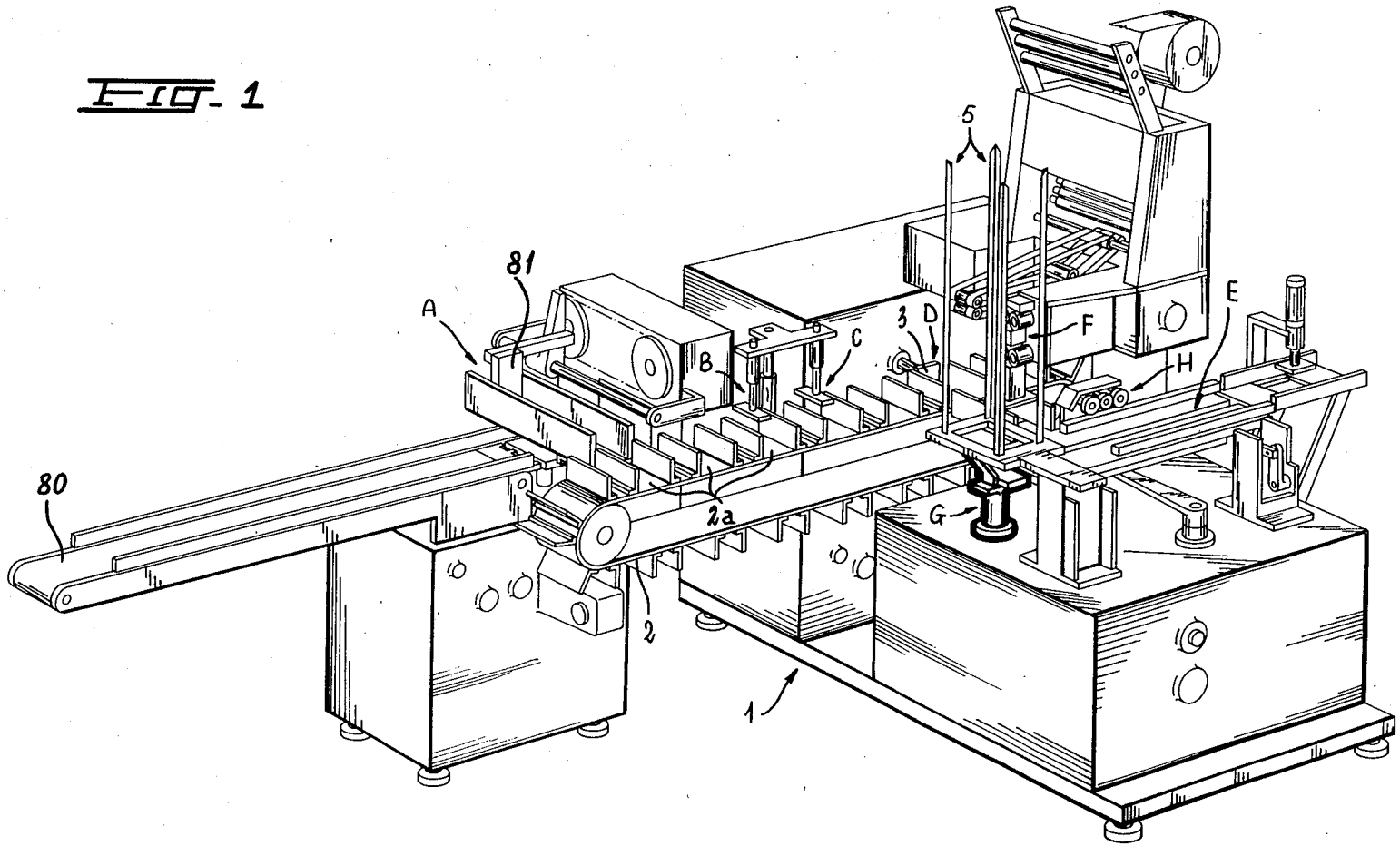
FIG. 1 is a perspective view of a packaging machine embodying my invention.

FIG. 1 shows a packaging machine 1 whose principal components include a conveyor 2 with compartments 2*a* designed to receive articles to be inserted into respective cartons. These articles, which could be in the form of blister packages, arrive on a conveyor 80 at a feeding station A here shown to comprise a pusher 81 serving to insert one or more of these packages during a given machine cycle into a conveyor compartment concurrently aligned therewith. In lieu of such a feeder I might also use an unstacker retrieving the packages from a hopper as disclosed in my copending application Ser. No. 345,372 filed Feb. 3, 1982 and now abandoned. The intermittently advancing conveyor 2 transports the articles past two checking stations B and C which determine, e.g. photoelectrically as known per se, the presence of a blister package in each compartment and the proper filling of such a package. The articles next arrive at a transfer station D where a pusher 3 thrusts them out of their compartments through a labeling station F and into respective cartons 4 (FIGS. 2–5) extracted from a hopper or stacking tube 5 in which these cartons are stacked in a folded state as more fully described hereinafter. The extraction, unfolding and loading of the cartons is accomplished by an assembly G, shown in heavier lines since it constitutes the subject matter of my present invention, from which the loaded cartons pass over a track E underneath a printer or marker H to a nonillustrated further destination for sealing and ultimate removal from the machine.

Figure 2:
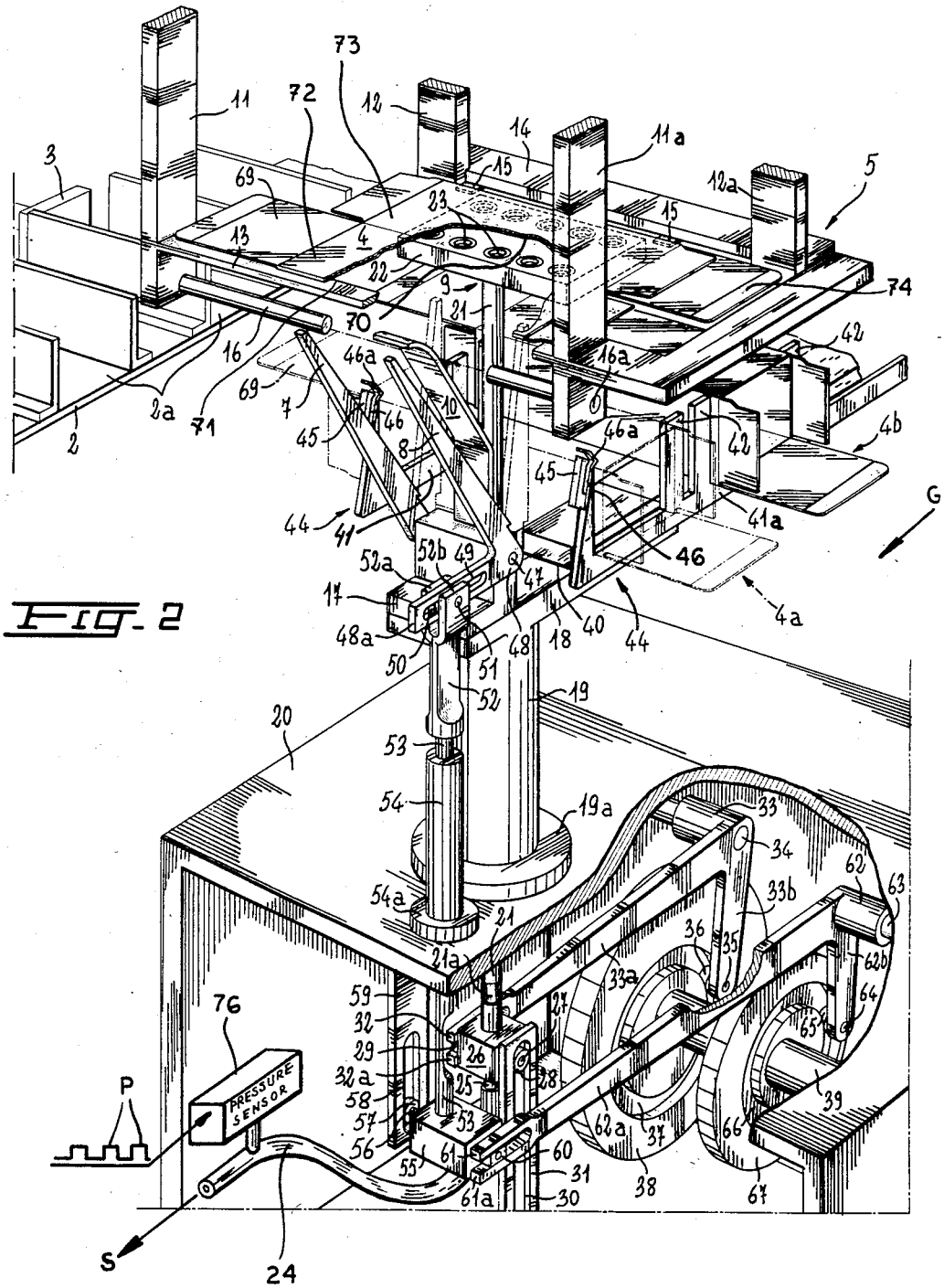
FIG. 2 is a perspective view, drawn to a larger scale, of an unfolding assembly included in the machine of FIG. 1.
Figure 3:
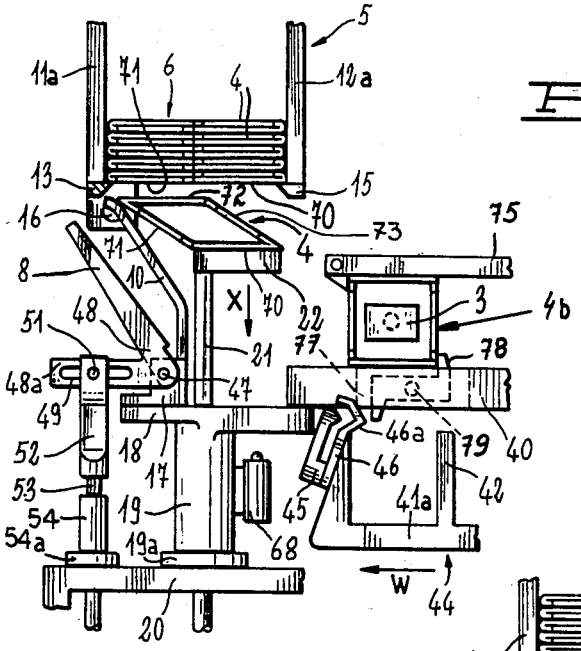
FIGS. 3 and 4 are side-elevational views of the unfolding assembly in two different operating positions.
Figure 4:
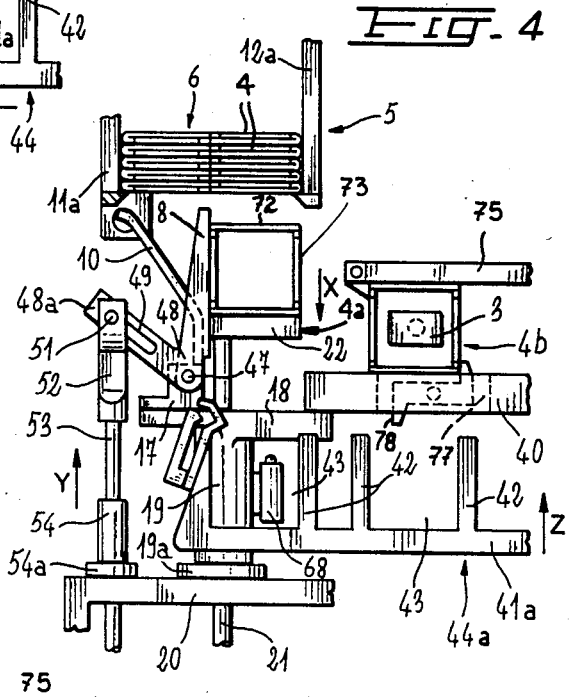
Figure 5:
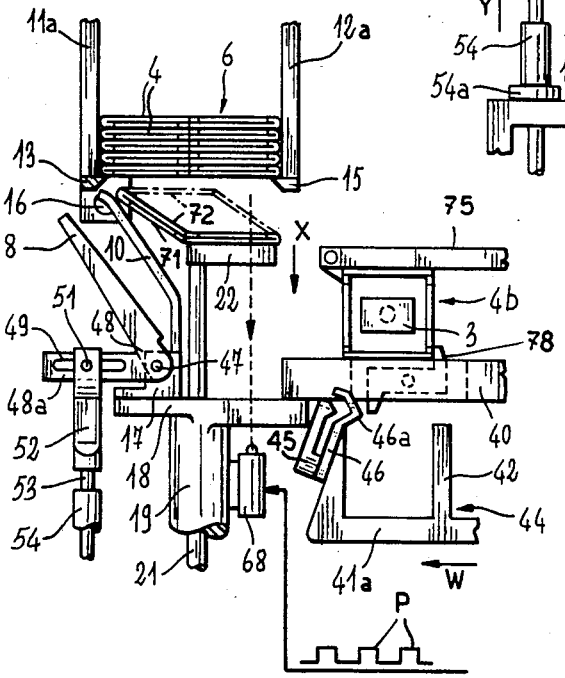
FIG. 5 is a view similar to FIG. 3, illustrating an irregular position of a carton withdrawn from a hopper or stacking tube by the assembly of FIGS. 2–4.

As more particularly illustrated in FIG. 2, assembly G comprises a pair of parallel arms 7, 8 which are rigidly interlinked by a shaft 47 traversing a block 17 atop a mounting plate 18; this plate is integral with a column 19 mounted by a flange 19*a* on a stationary machine housing 20. Arms 7 and 8 flank a ramp 10 which rises from block 17 and adjoins an extractor 9 disposed underneath hopper or stacking tube 5. The latter comprises a first pair of uprights 11, 11*a* and a second pair of uprights 12, 12*a* which serve for the guidance of flattened cartons 4 piled into a stack 6 (FIGS. 3–5). Each flattened carton consists of two layers of cardboard or the like, each layer comprising two body sections or panels and one end section or panel. More particularly, the lower layer includes a bottom section 70, a first lateral section 71 and an end section 74 extending from section 70 whereas the upper layer includes a top section 72, a second lateral section 73 and an end section 69 extending from section 72. Each carton also has foldable flaps to be pasted onto its end sections when the latter are turned into a vertical position for sealing the loaded carton. Uprights 11 and 11*a* are interconnected by a shelf 13 supporting sections 71, 72 and 69 of the lowermost carton of the stack while the remaining sections rest on short lugs 15 which project from a bar 14 interconnecting the uprights 12, 12*a*. Upright 11, which together with upright 12 is disposed in the vicinity of conveyor 2, further supports a horizontal deflecting rod 16 underlying the shelf 13 and extending toward ramp 10; a similar rod 16*a* aligned with rod 16 is supported by upright 11*a*. The two rods 16 and 16*a* are separated from ramp 10 by clearance sufficient to let the arms 7 and 8 swing past.

Extractor 9 comprises a shaft 21 which slides inside column 19 and forms a channel 21*a* terminating underneath a cross-head 26 in a nipple 25 by which this shaft can be coupled to a flexible hose 24 connected to an intake end of a suction pump as schematically indicated by an arrow S. The upper end of shaft 21 supports a plate 22 with suction cups 23 connected to channel 21*a*, plate 22 being aligned with the bottom section 70 of the lowermost carton of the stack 6 but being offset from the adjoining lateral section 71.

The cross-head 26 is traversed by a horizontal bolt 27 carrying at one end an idler roller 28 and at its other end a slider 29 straddled by prongs 32, 32*a* of a bifurcate extremity of an arm 33*a* of a lever 33 pivoted on a stud 34 within housing 20. Another arm 33*b* of lever 33 carries on its free end a pin 35 with a cam follower in the form of another idler roller 36 received in an eccentric groove 37 of a cam disk 38 which is mounted on a motor-driven shaft 39. Roller 28 is guided in a vertical slot 30 of a fixed plate 31.

Mounting plate 18 is rigid with a horizontal platform 40 acting as a support for an unfolded carton engaged by a comb-shaped transporter 44 which comprises a pair of parallel horizontal bars 41, 41*a* with upstanding teeth 42 forming pockets 43 (FIG. 4) for the reception of such a carton; in FIG. 2 I have shown in phantom lines the erecting position 4*a* of a carton 4 received in a first pocket and in full lines the loading position 4*b* of another carton received in a second pocket of the transporter whose operation will be more fully described hereinafter. The tooth 42 on the end of each bar proximal to column 19 carries a detent 45 with a resilient tongue 46 forming a catch 46*a* which serves to retain an engaged carton in the first pocket before that carton reaches the position 4*b* where it is overlain by a shelf 75 illustrated in FIGS. 3–5.

The swingable arm 8 is part of a lever 48 which has another arm 48*a* provided with a slot 49. A slider 50 in slot 49 is mounted on a pin 51 traversing prongs 52*a*, 52*b* of an upper extremity 52 of a shaft 53 which is guided in a sleeve 54; this sleeve rises alongside column 19 from the top of housing 20 to which it is secured by a flange 54*a*. The lower end of shaft 53 is connected to a cross-head 55 traversed by a bolt 56 which supports at one end an idler roller 57 and at its opposite end a slider 60. Roller 57 is received in a vertical guide slot 58 of a fixed plate 59 within housing 20; slider 60 is received between prongs 61 and 61*a* of a bifurcate extremity of an arm 62*a* forming part of a lever 62 which is fulcrumed on a stud 63 parallel to stud 34. Another arm 62*b* of lever 62 carries at its free end a pin 64 with a cam follower in the form of an idler roller 65 received in an eccentric groove 66 of a disk 67 also mounted on the driven shaft 39.

As shown in FIGS. 3–5, column 19 carries a photosensor 68 in a position in which it is aligned with the end flap 69 (FIG. 2) of a properly unfolded carton 4 extracted from hopper 5. The photosensor is illuminated by a light source (not shown) above the level of the unfolded end flap 69 but is activated only during part of each operating cycle by an enabling pulse P from a nonillustrated timer. Such enabling pulses P are also fed to a pressure sensor 76 which, as shown in FIG. 2, is mounted in housing 20 and is connected to suction hose 24 in order to determine whether the bottom section 70 of a carton 4 has been properly drawn onto the suction cups 23 of extractor plate 22.

I shall now describe the operation of the assembly shown in FIGS. 2–5.

At the beginning of an operating cycle, slave cam 37, 38 causes the lever 33 to elevate the shaft 21 whereby suction plate 22 comes into contact with the bottom section 70 of the lowermost carton 4 of the stack 6. The suction of cups 23 aspirates that section into contact with plate 22 whereupon the plate begins its descent as indicated in FIG. 3 by an arrow X. At the beginning of this descent the overhanging edge of lateral section 71, linked by a fold line with top section 72, comes into contact with rods 16, 16*a* and, substantially at the same time, with the top of ramp 10 whereby the carton 4 begins to assume a parallelogrammatic profile as seen in FIG. 3. Slave cam 66, 67 now causes the lever 62 to swing clockwise (FIG. 2) whereby shaft 53 is raised (arrow Y, FIG. 4) and imparts a similar pivotal motion to the swingable member consisting of arms 7 and 8. These arms thereupon swing past the ramp 10 into an upright position, shown in FIG. 4, in which their working surfaces lie close to the confronting edge of plate 22 in a vertical plane corresponding to the path of descent of the fold line between sections 70 and 71. This results in the erection of lateral section 71 and in a corresponding motion of sections 72 and 73 whereby the carton assumes a square or rectangular profile while laterally approaching the position 4*a* referred to in connection with FIG. 2.

Transporter 44 is intermittently advanced in a clockwise loop by a nonillustrated linkage coupled with the machine drive which shifts its first pocket at a lower level, according to an arrow W shown in FIG. 3, from a location aligned with container position 4*b* to a location underlying container position 4*a* whereupon the transporter is elevated as indicated by an arrow Z (FIG. 4) to engage the extracted and unfolded carton. At its elevated level, seen in FIG. 2, transporter 44 then laterally moves that carton to position 4*b* underneath shelf 75 where the carton is aligned with pusher 3 and with a compartment 2*a* of the momentarily arrested conveyor 2, the pusher then advancing to load the carton with the contents of that compartment through the open end overhung by section 69. The carton-supporting platform 40 is provided with a cutout 77 accommodating a detent 78, pivoted to it at 79, which holds the carton in place during the subsequent descent of the transporter 44 to the level shown in FIG. 4. In the next cycle a ledge (not shown) spanning bars 41, 41*a* of the rising transporter engages the detent 78 and releases the loaded carton in position 4*b* which thus can now be pushed farther to the right by an adjoining tooth 42 as the next carton is being moved into its place laterally from position 4*a*. In each cycle, therefore, a number of cartons are advanced by the transporter 44 over platform 40, forming part of the track E of FIG. 1, past printing section H toward the end of that track for sealing and discharge from the machine.

The catch 46*a* of detent 45 is readily cammed aside when the transporter 44 rises to receive in its first pocket the unfolded carton in position 4*a*. After that carton has been shifted into position 4*b* underneath shelf 75, the catch also yields to let the transporter descend to its lower level.

The aforementioned timer also controls the application of suction to the cups 23 of plate 22 so as to release the extracted carton as soon as it is bracketed by the transporter teeth in position 4*a*. Prior to that release, i.e. during the descent of the carton from the stack 6 to the position of FIG. 4, pressure sensor 76 of FIG. 2 is enabled by a pulse P to detect the possible absence of an engaged carton in which case the air pressure in hose 24 would be at a near-atmospheric level rather than at the low level normally created by the pump. Upon detecting such a malfunction, sensor 76 would emit an alarm signal and/or arrest the machine.

As illustrated in full lines in FIG. 5, a carton extracted from the hopper might on occasion fail to open into the parallelogrammatic shape represented in phantom lines. End flap 69 (FIG. 2), being coplanar with top section 72, would in that instance remain substantially in line with lateral section 71 instead of approaching the horizontal position of the top section shown in FIG. 4. In such a case the photosensor 68, during its enablement by a pulse P, would be illuminated by the associated light source and would therefore also emit a signal alerting the operator and/or arresting the machine.

Practical tests have shown that a packaging machine equipped with an assembly as disclosed in FIGS. 2–5 can have a much higher output rate than one of conventional construction.

I claim:

1. An apparatus for unfolding and erecting flattened cartons in a packaging machine, said apparatus comprising:

a pair of guides for stacking said flattened cartons therebetween, said cartons having at least one pair of panels joined by a fold;

an extractor disposed below one of said panels and provided with vertically reciprocable suction means aligned and engageable with only one of said panels for removing same downwardly from said guide;

a fixed ramp disposed below the other of said panels to one side of said fold and to one side of said guides and inclined downwardly toward said suction means for engaging and lifting said other panel inwardly toward the other side of said guides along said fold into a partially erect position as said other panel is drawn along said ramp upon downward movement of said suction means past said ramp;

at least one arm pivotable about an axis parallel to said fold and disposed below said ramp to said one side of said fold and swingable upwardly and inwardly past said ramp to engage said other panel and raise same to a fully erect position while said other panel is descending, said arm having a vertical surface contacting and guiding said other panel over the full height thereof in said fully erect position;

common drive means for the synchronzied displacement of said pivotable arm and said vertically reciprocable suction means;

means for the lateral displacment of said carton in the direction of the inward pivoting of said arm in the fully erect position thereof and in a direction away from said ramp and said vertical surface defining an erecting position to a loading position adjacent thereto, including a comb-like transporter having first and second pockets of fixed outline positioned with the first pocket thereof aligned below said carton in the erecting position thereof and said second pocket is aligned below another carton in the loading position thereof, means for displacing said transporter vertically and laterally whereby said transporter is displaced upwardly to engage the carton in the erecting position and the carton in the loading position respectively in said first and second pockets, whereupon said transporter is displaced laterally to shift said first carton from said erecting position to said loading position and said other carton from said loading position for further processing, whereupon said transporter is displaced downwardly releasing the respective cartons, said transporter then being displaced laterally again to align the first and second pockets thereof respectively with said erecting position and said loading position, said transporter traversing a rectilinear path in a clockwise direction; and means for the endwise introduction into the cartons in the loading position thereof of goods to be packaged.

2. The assembly defined in claim 1 wherein said swingable arm comprises two parallel arms flanking said ramp.

3. The assembly defined in claim 1 or 2 wherein said common drive means comprising a pair of corotating cams.

4. The assembly defined in claim 1 or 2, further comprising pressure-sensing means coupled with said suction means and enabled during a descent thereof for detecting a possible absence of an engaged carton.

5. The assembly defined in claim 1 or 2 wherein each carton has an outlying section integral and coplanar with one of said pair of panels so as to occupy a position whereby photosensing means aligned with the unfolded position of said end section is enabled during a descent of said suction means to detect a possible failure of an engaged carton to expand.

6. The assembly defined in claim 1 or 2 further comprising a pair of aligned horizontal rods paralleling said axis and bracketing the top of said ramp with clearance for said swingable arm.

7. The assembly defined in claim 1 wherein each carton has an outlying section integral and coplanar with one of said pair of panels so as to occupy a position whereby photosensing means aligned with the unfolded position of said end section is enabled during a descent of said suction means to detect a possible failure of an engaged carton to expand.

* * * * *